United States Patent [19]
Wasson
[11] 4,055,449
[45] Oct. 25, 1977

[54] AQUEOUS BLASTING COMPOSITION WITH CRYSTAL HABIT MODIFIER

[75] Inventor: Daniel A. Wasson, Sandy City, Utah

[73] Assignee: Ireco Chemicals, Salt Lake City, Utah

[21] Appl. No.: 713,557

[22] Filed: Aug. 11, 1976

[51] Int. Cl.² ..... C06B 45/00

[52] U.S. Cl. ..... 149/2; 149/46; 149/60; 149/61; 149/112

[58] Field of Search .....149/2, 44, 46, 60, 149/61, 112

[56] References Cited

U.S. PATENT DOCUMENTS 3,397,097 8/1968 Atadan et al. ..... 149/60 X 3,617,404 · 11/1971 Lyerly ..... 149/62 X

*Primary Examiner*—Stephen J. Lechert, Jr.
*Attorney, Agent, or Firm*—Robert A. Bingham

[57] ABSTRACT

The stabilization of a fine dispersion of an immiscible liquid hydrocarbon fuel throughout an aqueous blasting composition having a continuous aqueous phase is accomplished by the use of a crystal habit modifier to reduce the crystal size of the oxidizer salt in the composition. Such reduction is found to be critical for stabilizing the fine dispersion of immiscible hydrocarbon fuel droplets throughout the composition and resultantly for maintaining the sensitivity of the composition to detonation.

20 Claims, No Drawings

AQUEOUS BLASTING COMPOSITION WITH CRYSTAL HABIT MODIFIER

The present invention relates to improved explosive compositions of the aqueous gel or slurry type (hereafter referred to as "aqueous blasting compositions") and to an improved method of sensitizing such compositions. More particularly, the invention relates to aqueous explosive blasting compositions having a continuous aqueous phase and comprising inorganic oxidizer salt, water, immiscible liquid hydrocarbon fuel finely and stably dispersed throughout the aqueous phase and thickener, with the improvement comprising a crystal habit modifier to reduce the crystal size of the oxidizer salt in the composition. Such reduction is found to be critical for stabilizing the fine dispersion of immiscible liquid hydrocarbon fuel droplets throughout the composition and resultantly for maintaining the sensitivity of the composition to detonation. The method of sensitizing the compositions relates to the addition of a crystal habit modifier to the compositions.

BACKGROUND OF THE INVENTION

Explosives or blasting compositions of the aqueous gel or slurry type, commonly referred to as slurry explosives or blasting agents, and referred to herein as aqueous blasting compositions, have achieved wide acceptance as commercial blasting agents owing to their low cost, safety and inherent water resistance. Aqueous blasting compositions, containing a continuous liquid phase and comprising generally an inorganic oxidizing salt, usually predominantly ammonium nitrate (AN), a thickening agent for the liquid phase in which some or all of the oxidizing salt is dissolved, a fuel and/or sensitizer and, optionally, other ingredients such as gassing and cross-linking agents, have been very successful even in water-containing boreholes due to their inherent water resistance. Another advantage of these compositions is that they are readily pumpable immediately after formulation at an elevated temperature and can therefore be pumped from a mixing chamber into a borehole for detonation. Due to the fluid nature of these compositions during pumping, essentially complete coupling with the surfaces of the borehole is achieved. If desired, the compositions can also be packaged through an extrusion apparatus such as described in U. S. Pat. No. 3,783,735.

Attempts are continually made to reduce the ingredient costs of aqueous blasting compositions in order to increase their competitiveness with non-aqueous compositions such as ANFO. A major proportion of ingredient costs is for the fuel and sensitizer ingredients. Fine, hydrophobic aluminum particles are commonly employed as both fuel and sensitizer in aqueous blasting compositions. Other fuels find substantial use as well, for example, miscible liquid hydrocarbon fuels such as ethylene glycol, formamide, etc.; sulfur; carbonaceous materials; polysaccarides; starches and others. Until recently, soluble fuels have been particularly preferred because they allow for molecular contact between fuel and oxidizer molecules which are in solution in the continuous aqueous phase of the aqueous blasting composition. This molecular contact enhances sensitivity to detonation. Ethylene glycol probably has been the most commonly used soluble fuel and aluminum particles are usually combined with ethylene glycol as additional fuel and/or sensitizer. However, this and other combinations of fuels are relatively expensive.

More recently, immiscible liquid hydrocarbon fuels have been used due to their lower cost. See, for example, U.S. Pat. Nos. 3,787,254 and 3,2788,909. A preferred immiscible fuel is No. 2 fuel oil. However, the use of an immiscible liquid fuel in an aqueous blasting composition having a continuous aqueous phase has presented problems. The major problem has been the effecting and stabilizing of a desired fine dispersion of the immiscible fuel in small droplets throughout the aqueous phase. It is found that unless a fine dispersion is maintained the sensitivity of the composition is greatly reduced. It is believed that this loss of sensitivity is due to the segregation or separation of oxidizer and fuel due to the coalescence of dispersed immiscible liquid fuel droplets. It has been observed that bulk loaded compositions can lose their sensitivity within a few hours due to coalescence and breakdown of the fuel dispersion.

Previous means have been employed to maintain a stable, fine dispersion of the immiscible fuel droplets throughout the liquid phase. Emulsifyng agents have been employed, but such agents are relatively expensive. The use of significant proportions of calcium nitrate (CN) as part or all of the oxidizer salt has been found to effect and stabilize the dispersion (U.S. Pat. No. 3,787,254). A formulation procedure involving the prethickening of the aqueous, salt-containing phase of the composition prior to the addition of the immiscible liquid fuel has also been found to effect and stabilize the dispersion (U.S. Pat. No. 3,788,909). In the present invention, it has been found that the use of a crystal habit modifier to control the crystal size of the oxidizer salt in the composition greatly increases sensitivity by maintaining a stable, fine dispersion of the immiscible liquid fuel. This effect is additive to the other means describes above of effecting and stabilizing the dispersion.

The use of crystal habit modifiers in aqueous blasting compositions is known. U.S. Pat. No. 3,397,097 discloses the use of a crystal habit modifier in a thickened aqueous inorganic oxidizer salt blasting composition containing a soluble fuel as opposed to an insoluble fuel. The modifier was used to control the size of the crystals of the inorganic oxidizer salts upon precipitation of the salts from the hot inorganic oxidizer salt solution used in formulating the compositions. It was disclosed that the crystal habit modifier, employed in combination with gas-filled cavities and soluble fuel, enhanced the sensitivity of the blasting compositions at low temperatures by keeping the salt crystals small. (Col. 5, line 20–35). All of the soluble fuels disclosed in the U.S. Pat. No. 3,397,097 patent are water-miscible fuels. The increased sensitivity resulted simply from more intimate contact between oxidizer and fuel constituents due to the reduced size and increased surface area of the oxidizer salt particles. However, when a crystal habit modifier is used in an aqueous blasting composition containing an immiscible liquid fuel, an additional surprising and unexpected result occurs.

Not only are the precipitated crystals smaller in size and larger in surface area than if the modifier were not present, which is known, but also the fine crystal structure forms in effect a matrix which maintains or stabilizes the immiscible liquid fuel droplets in a dispersed state. Thus not only does the modifier sensitize by reducing crystal size but also by acting, in effect, as a long-term dispenser of the immiscible fuel. It is found that the use of a crystal habit modifier in aqueous blasting compositions containing immiscible liquid fuels produces such a surprising impact upon sensitivity, particularly with time, that it use can mean the difference between a practicably successful and unsuccessful composition. The use of the modifier creates storage life where essentially none existed previously. The examples below illustrate this phenomenon.

SUMMARY

The present invention relates to an aqueous blasting composition having a continuous aqueous phase and comprising inorganic oxidizer salt, water, immiscible liquid hydrocarbon fuel finely and stably dispersed throughout the aqueous phase, thickener and, as the improvement, a crystal habit modifier to reduce the crystal size of the oxidizer salt and thereby increase the stability of the fine dispersion of the immiscible liquid fuel throughout the composition. The crystal habit modifier is preferably an anionic surfactant and as sodium methylnapthalene sulfonate. The modifier is preferably used in amount from about 0.05% to about 3.0% by weight. Gassing and cross-linking agents are preferably employed. The present invention also relates to a method of sensitizing an aqueous blasting composition. The method comprises adding a crystal habit modifier to an aqueous blasting composition having a continuous aqueous phase and comprising oxidizer salt at least partially dissolved in the aqueous phase; water; thickener and an immiscible liquid hydrocarbon fuel, such as No. 2 fuel oil, finely and stably dispersed throughout the aqueous phase. The modifier is added to the aqueous salt-containing phase of the composition at a temperature above the crystallization temperature of the oxidizer salt in the phase. Thus, when precipitation of the salt occurs, it is controlled by the presence of the modifier.

DETAILED DESCRIPTION OF THE INVENTION

The basic concept of the present invention is to use a crystal habit modifier in an aqueous blasting composition containing immiscible liquid hydrocarbon fuel droplets which are finely dispersed throughout the continuous aqueous phase of the composition. The modifier stabilizes the dispersion by controlling the crystal size of the oxidizer salt crystals which precipitate out of solution upon cooling of the composition from its elevated formulation temperature. Thus the crystals which precipitate in the presence of the modifier are relatively small and have a relatively large surface area and appear to form a network or matrix throughout the aqueous phase of the composition. This matrix stabilizes the dispersed immiscible fuel droplets against migration and coalescence and thus maintains intimate contact between oxidizer and fuel.

The compositions of the present invention are generally prepared by first forming a solution of the oxidizer salt and water at a temperature above the crystallization temperature of the salt in solution (generally about 20° C or higher). This solution is maintained at an elevated temperature of about 10° C above its crystallization temperature or fudge point. The crystal habit modifier is then added to this hot oxidizer salt solution. (It is possible, but not advantageous, to add the modifier to the water prior to the addition and dissolution of the oxidier salt in the water.) The solution is then preferably pre-thickened by incorporation of part or all of the thickening agent. Although pre-thickening aids in effecting and maintaining a dispersion of the immiscible liquid fuel, it is not necessary that the thickener be pre-incorporated into the solution prior to the addition of the liquid fuel and other ingredients. The immiscible liquid hydrocarbon fuel is incorporated into and uniformly dispersed throughout the solution by a mechanical stirring means as is well-known in the art. Upon cooling of the newly-formulated composition, the oxidizer salt will begin to precipitate from the solution at temperatures of crystallization or below. The presence of the crystal habit modifier will induce the formation of crystals of smaller particle size and larger specific surface area than those formed in the absence of the modifier. These finer crystals, which are long and needle-like, form a matrix which inhibits migration and coalescence of the originally dispersed droplets. The maintainence of the dispersion is probably due either to adsorption of the droplets on the surface of the fine crystals, which have a high specific surface area, or to prevention of migration of the droplets by a physical network of fine, elongated salt crystals. In any event, the important point is that the use of a crystal habit modifier significantly stabilizes the dispersion of the immiscible liquid fuel droplets throughout the aqueous phase.

The oxidizer salt or salts are selected from the group consisting of ammonium and alkali metal nitrates and perchlorates and ammonium and alkaline earth metal nitrates and perchlorates. Preferably, the oxidizer salt is AN alone or in combination with sodium nitrate (SN). CN can also be used. The amount of oxidizer salt employed is generally from about 50% to about 80% by weight of the total composition and preferably from about 60% to about 75%. Preferably, all of the oxidizer salt is dissolved in the oxidizer salt solution during formulation of the compositions. However, additional and undissolved oxidizer salt can be added to the salt solution during formulation of the composition, as illustrated in the examples below. Most of this additional dry salt will remain undissolved during the formulation and mixing procedure. The additional oxidizer salt would normally be AN in either prill or ground form. However, if solid oxidizer salt is added to the solution, it is preferable that it be in ground rather than prill form. As is shown in the examples below, the presence of AN prills in a composition reduces its sensitivity as a function of temperature over compositions which do not contain prills. The explanation for this reduction in sensitivity is consistent with the explanation for enhanced sensitivity when using the crystal habit modifier; namely, the presence of AN in large particle sizes causes a breakdown of the dispersion of the immiscible fuel. The use of ground AN rather than prilled AN results in a dramatic increase in sensitivity because of the dispersing network of fine particles or crystals. This result is also shown in the examples below and is consistent with the observed relationship between oxidizer salt particle size and composition sensitivity. In one respect it is advantageous to add ground AN to the solution rather than have all of the oxidizer salt in solution because compositions containing ground AN have more energy than an all-solution composition. If ground AN is used, it should preferably be of a particle size 20 Tyler mesh or smaller.

It should be mentioned that commercially available AN usually is coated with a small amount of a crystal habit mofidier such as sodium methylnapthalene sulfonate ("Petro-AG") or other surfactant or conditioning agent. The AN is coated to reduce its normal tendency to swell and cake on standing. The amount of such coating is quite small, e.g., about 0.05% by weight of AN or less. The amount is insufficient for the purposes of the present invention. As indicated below, at least 0.05% by weight, based on the total composition, of modifier is used in addition to that present as an AN coating. All references in this specification to amounts of crystal habit modifier exclude that present as AN coating.

The total amount of water present in the composition is generally from about 10 to about 35% by weight. The use of water in amounts within this range will generally allow the compositions to be fluid enough to be pumped by conventional slurry pumps at elevated formulation or mixing temperatures (above the fudge point of the composition). After pumping, precipitation of at least part of the oxidizer salt will occur upon cooling to temperatures below the fudge point.

The immiscible liquid hydrocarbon fuel is preferably present in amounts from about 2 to about 12% by weight. The actual amount used depends upon the particular immiscible fuel and supplemental fuels (if any) used. Preferably, the amount of fuel used is such to result in an overall oxygen balance of the composition of ± 25 percent. Fuel oil, when used, is normally used in amounts of from about 2 to about 8% by weight, preferably from about 3 to about 7%, and when used as the sole fuel, is preferably used in amounts of from about 4 to about 6% by weight. The immiscible hydrocarbon fuels can be aliphatic, alicyclic, and/or aromatic and either saturated and/or unsaturated. For example, benzene, toluene, and the xylenes can be employed. Preferred fuels include mixtures of normally liquid hydrocarbons generally referred to as petroleum distillates such as gasoline, kerosene and diesel fuels. A particularly preferred liquid fuel is No. 2 fuel oil. Tall oil and paraffin oil can also be used. Mixtures of any of the above fuels can also be used.

Optionally, and in addition to the immiscible liquid hydrocarbon fuel, solid or other liquid fuels or both can be employed in selected amounts. Examples of solid fuels which can be used are particulate aluminum; carbonaceous materials such as gilsonite or coal; vegetable-grain such as wheat; etc. Miscible liquid fuels can include alcohols such as methyl alcohol, glycols such as ethylene glycol, amides such as formamide, and analagous nitrogen-containing liquids. These liquids generally act as a solvent for the oxidizer salt and, therefore, can replace water to varying degrees. Normally, when a stable, fine dispersion of the immiscible liquid hydrocarbon fuel is obtained, as in the present invention, additional fuels in solid or liquid form are not necessary.

The aqueous fluid phase of the composition is rendered viscous by the addition of one or more thickening agents of the type and in the amount commonly employed in the art. Such thickening agents include galactomannin, preferably guar, gums; guar gum of reduced molecular weight as described in U.S. Pat. No. 3,788,909; polyacrylamide and analogous synthetic thickeners, flours, and starches. A particularly preferred thickening agent is a biopolymer gum, which is described in U.S. Pat. No. 3,788,909. This '909 patent discloses that the use of a biopolymer gum in aqueous blasting compositions containing an immiscible liquid hydrocarbon fuel is particularly advantageous in maintaining the liquid fuel in a finely dispersed state. A preferred combination thickening agent is from about 0.1 to about 0.2% biopolymer gum and from about 0.05 to about 0.50% guar gum. Flours and starches may be employed in much greater amounts, up to about 10%, in which case they also function importantly as fuels.

As is well-known in the art, gassing agents are preferably employed to lower and control the density of and to impart sensitivity to aqueous blasting compositions. The compositions of the present invention preferably employ a small amount, e.g., about 0.01 to about 0.2% or more of such gassing agent in order to obtain a composition density of less than about 1.3 gm/cc. A preferred gassing agent is a nitrite salt such as sodium nitrite, which decomposes chemically in the solution of the composition to produce gas bubbles. Thiourea is preferably employed to accelerate the decomposition of a nitrite gassing agent. Gas bubbles can also be entrained in the thickened aqueous phase of the composition during mixing. Hollow particles such as hollow spheres, styrofoam beads and plastic micro-balloons are also commonly employed as a gassing means. Two or more of these common gassing means may be employed simultaneously.

Preferably the crystal habit modifiers are anionic surfactants, although cationic surfactants can be used. U.S. Pat. No. 3,397,097 lists modifiers of the type used in the present invention. A particularly preferred modifier is sodium methylnaphthalene sulfonate "Petro-AG"). Other modifiers are higher ($C_8$–$C_{18}$) alcohol sulfonic esters, e.g., sodium lauryl and sodium stearyl sulfate; aliphatic alcohol phosphates such as sodium alkyl phosphates and alkyl phosphate triethanol amine; aliphatic amide sulfonates such as sodium stearyl amide methylethylsulfonate and sodium aliphatic amide alkyl ethylsulfonate; alkyl-aryl sulfonates and sodium dinaphthylmethane disulfonates. The crystal habit modifier is preferably present in the amount of from about 0.05 to about 3% by weight and most preferably present in the amount of from about 0.5 to about 2.0%. of inorganic oxidizing salt while the solution is at a temperature As previously explained, the modifier must be added to the solution above the crystallization point of the salt or salts in solution. In order for the modifier to control the salt crystal size upon precipitation, it must be present before precipitation occurs. It is preferable but not necessary that the crystal habit modifier be added to the hot salt solution prior to the incorporation of other ingredients.

Cross-linking agents in combination with suitable cross-linkable thickening agents are preferably employed in order to further stabilize the fine dispersion or distributions of the droplets of liquid hydrocarbon fuel, as well as to prevent the undesired escape or migration of gas bubbles, and thus to maintain the sensitivity of the composition of detonation. Cross-linking agents are also especially useful where the stability or integrity of the composition must be maintained in the presence of water-containing boreholes. Excellent cross-linking of guar gum can be obtained by using a small amount, e.g., about 0.05 to about 0.2%, of an aqueous solution of sodium dichromate. Other cross-linking agents will be apparent to those skilled in the art.

In the following examples, all compositions were prepared according to the preferred method of formulation described above. All detonation tests were made a minimum of 18 hours after formulation.

In illustration of the present invention, Table 1 contains the formulations and detonation results of various compositions, some of which contain a crystal habit modifier and some of which do not. Examples A through D illustrate the effect on sensitivity of adding AN prills in increasing amounts. As shown from the detonation results, the sensitivity of the composition decreases correspondingly as the content of the AN prills is increased. For example, composition A detonated successfully in a four-inch charge diameter at 5° C, whereas composition D, which contained 20% prilled AN, failed to detonate even in a six-inch charge diameter. (As is well-known in the art, a more sensitive composition will satisfactorily detonate in a smaller charge diameter than a less sensitive composition.) This loss of sensitivity can be explained by the large size of the AN prills, which cause a degree of breakdown in the dispersion of the fuel oil in spite of the presence of a crystal habit modifier. It appears that the presence of prills makes the beneficial effect of the crystal habit modifier to the degree corresponding to the amount of prills present. Compositions E and F compare the effect on sensitivity of replacing prilled AN with ground AN in compositions not containing a crystal habit modifier. As is shown from the detonation results, composition E is slightly more sensitive than F (in the 6-inch charge diameter it has a higher detonation velocity than composition F) as would be expected because of the finer size of the oxidizer salt reactant. However, when a crystal habit modifier is incorporated into the compositions of E and F, as in compositions G and H, respectively, the difference in sensitivity is dramatically in favor of the composition containing ground AN. In fact, composition G compares favorably in sensitivity to composition I, which contains all of the oxidizer salt in solution. The results in Table 1 illustrate the dramatically beneficial effect of using a crystal habit modifier to control crystal growth in aqueous blasting compositions containing immiscible liquid hydrocarbon fuels; e.g., compare compositions E and G. Table 1 also illustrates that the addition of solid, ground AN does not appreciably detract from the beneficial results obtained from using a crystal habit modifier. The use of ground AN and crystal habit modifier both result in the presence of small AN particles or crystals which effect a stable dispersion of the immiscible liquid fuel. One explanation for the observed decrease in sensitivity when using AN prills is that the AN precipitating from the solution may grow on the prills dispersed throughout the composition and thus the growth of a fine crystalline network of AN crystals is prevented and the dispersing effect of such a network is lost.

Table 2 illustrates the results of using varying amounts of crystal habit modifier. Within the amounts of crystal habit modifier used in the compositions in this table, i.e., up to 1.5%, sensitivity increased correspondingly with increasing amounts of modifier. Thus as more crystal habit modifier is added to the solution containing oxidizer salt, the growth of the size of precipitated oxidizer salt crystals is correspondingly more impeded. This effect is particularly important at low temperatures, where more salt is precipitated, as is shown by the detonation results in Table 2 for compositions E-G at 5° C as compared with those at 20° C.

Table 3 contains the formulations and detonation results of several compositions of the present invention having additional ingredients or different kinds of ingredients of the same type. The detonation results for compositions A and B after thirteen day's storage at 5° C are given. These results indicate that an effective dispersion of fuel oil was maintained during the storage period. Of particular interest is the fact that compositions A and B are designed to be packaged in cylindrical sausage form. All other compositions disclosed in this specification were designed primarily for direct placement into a borehole or other receptable for subsequent detonation. Thus the compositions of the present invention can be packaged and stored for later use or can be placed directly into a borehole immediately after formulation.

While the present invention has been described with reference to certain illustrative examples and preferred embodiments, various modifications will be apparent to those skilled in the art and any such modifications are intended to be within the scope of the invention as set forth in the appended claims.

TABLE 1

| COMPOSITION INGREDIENTS (Parts by Weight) | A | B | C | D | E | F | G | H | I |
|---|---|---|---|---|---|---|---|---|---|
| Solution[a,b] | 94.55[a] | 89.55[a] | 83.45[a] | 73.45[a] | 70.0[b] | 70.0[b] | 69.0[b] | 69.0[b] | 94.55[b] |
| Crystal habit modifier[c] (in solution) | a | a | a | a | — | — | 1.0 | 1.0 | 1.4 |
| No. 2 Fuel Oil | 5.00 | 5.00 | 5.00 | 5.00 | 5.0 | 5.0 | 5.0 | 5.0 | 5.0 |
| Prilled AN | — | 5.00 | 10.00 | 20.00 | — | 24.78 | — | 24.78 | — |
| Ground AN (~20 mesh) | — | — | — | — | 24.78 | — | 24.78 | — | — |
| Cross-linking agent[d] | 0.20 | 0.20 | 0.20 | 0.20 | 0.2 | 0.2 | 0.2 | 0.2 | 0.2 |
| Gassing Agent[e] | 0.25 | 0.25 | 0.25 | 0.25 | 0.2 | 0.2 | 0.2 | 0.2 | 0.2 |
| Density at 20° C (g/cc) | 1.00 | 1.01 | 1.00 | 1.00 | 1.06 | 1.06 | 1.06 | 0.99 | 1.01 |
| Detonation results[f] | | | | | | | | | |
| 20° C (Charge dia.) | | | | | | | | | |
| 2.5" | — | — | — | — | F | F | D | F | — |
| 3" | 4.2 | D | D | LOD | F | F | 4.2 | F | 4.2 |
| 4" | D | 5.1 | 4.3 | 3.9 | LOD | F | 4.6 | 3.5 | 4.9 |
| 5" | — | — | — | — | D | D | D | D | D |
| 6" | — | — | — | — | 4.2 | 3.3 | D | 3.3 | D |
| 5° C | | | | | | | | | |
| 3" | F | F | F | F | — | — | — | — | — |
| 4" | 4.2 | F | F | F | — | — | — | — | — |
| 5" | 5.1 | 3.2 | F | F | — | — | — | — | — |
| 6" | — | — | 3.3 | F | — | — | — | — | — |

| Key: Solution | AN | $H_2O$ | Thiourea | Bipolymer gum | Guar gum | Crystal habit modifier[c] |
|---|---|---|---|---|---|---|
| 1 | 75.79 | 22.50 | 0.15 | 0.15 | 0.35 | 1.06 |
| b | 76.70 | 22.75 | 0.15 | 0.07 | 0.33 | (See above) |

[c]Sodium methylnapthalene sulfonate
[d] 1 sodium nitrite/$4H_2O$
[e]15 $H_2O$/4 sodium dichromate/3 sodium bisulfate
[f]D = detonated; F = failed; LOD = low order detonation; number = detonated at velocity given in km/sec.

TABLE 2

| COMPOSITION INGREDIENTS (Parts by Weight) | A | B | C | D | E | F | G |
|---|---|---|---|---|---|---|---|
| Solution[1] | 94.62 | 94.47 | 94.52 | 94.3 | 94.05 | 93.55 | 93.05 |
| Crystal habit modifier (in solution)[2] | — | 0.05 | 0.10 | 0.25 | 0.50 | 1.00 | 1.50 |
| No. 2 Fuel Oil | 5.00 | 5.00 | 5.00 | 5.00 | 5.00 | 5.00 | 5.00 |
| Cross-Linking Agent[3] | 0.20 | 0.20 | 0.20 | 0.20 | 0.20 | 0.20 | 0.20 |
| Gassing Agent[4] | 0.18 | 0.18 | 0.18 | 0.25 | 0.25 | 0.25 | 0.25 |
| Density at 20° C | 1.08 | 1.11 | 1.10 | 1.03 | 1.00 | 1.03 | 1.00 |
| Detonation Results[5] | | | | | | | |
| 20° C (Charge dia.) | | | | | | | |
| 3" | F | F | F | D | D | D | D |
| 4" | F | 3.7 | 3.5 | 4.8 | 4.7 | 4.9 | 4.6 |
| 5" | D | D | D | — | — | — | — |
| 5° C (Charge dia.) | | | | | | | |
| 3" | — | — | — | F | F | F | 4.5 |
| 4" | F | — | — | F | D | 4.2 | D |
| 5" | — | — | — | D | D | 4.5 | D |
| 6" | F | F | F | D | D | 4.4 | D |

Key:

| [1] Solution: | AN | $H_2O$ | Thiourea | Biopolymer gum | Guar gum |
|---|---|---|---|---|---|
| | 76.60 | 22.75 | 0.15 | 0.15 | 0.35 |

[2] sodium methylnaphthalene sulfonate
[3] 15 $H_2O$/4 sodium dichromate/3 sodium bisulfate
[4] 1 sodium nitrite/4 $H_2O$
[5] D = detonated; F = failed; number = detonated at velocity given in km/sec

TABLE 3

| COMPOSITION INGREDIENTS (Parts by Weight) | A | B | C | D | E | F | G | H | I | J | K |
|---|---|---|---|---|---|---|---|---|---|---|---|
| Solution[a,b,c,d,e,f,g] | 94.60[a] | 92.6[b] | 91.65[c] | 89.65[c] | 95.65[d] | 90.65[d] | 95.15[d] | 91.65[d] | 95.65[e] | 93.65[f] | 92.5[g] |
| Crystal habit modifier (in solution) | a | b | c | c | d | d | d | d | e | f | 1.0[h] |
| No. 2 Fuel Oil | 5.0 | 4.0 | 5.0 | 4.0 | 4.0 | — | — | — | 4.0 | 3.0 | 7.0 |
| Nitrotoluene | — | — | — | — | — | — | — | 8.0 | — | — | — |
| Nitrobenzene | — | — | — | — | — | 9.0 | — | — | — | — | — |
| Xylene | — | — | — | — | — | — | 4.5 | — | — | — | — |
| Brazillian tapioca flour | — | 3.0 | — | — | — | — | — | — | — | 3.0 | 3.0 |
| Aluminum (atomized) | — | — | 3.0 | 6.0 | — | — | — | — | — | — | — |
| Cross-linking agent[i] | 0.20 | 0.20 | 0.15 | 0.15 | 0.15 | 0.15 | 0.15 | 0.15 | 0.15 | 0.15 | 0.15 |
| Gassing agent[j] | 0.20 | 0.20 | 0.2 | 0.2 | 0.2 | 0.2 | 0.2 | 0.2 | 0.2 | 0.2 | 0.25 |
| Density at 20° C (5° C) | (1.11) | (1.12) | (1.08) | (1.06) | 1.11 | 1.06 | 1.11 | 1.10 | 1.12 | 1.1 | (1.05) |
| Detonation results[k] | | | | | | | | | | | |
| 20° C (Charge dia.) | | | | | | | | | | | |
| 2" | — | — | — | — | D | D | D | D | — | — | — |
| 3" | — | — | — | — | — | — | — | — | D | F | — |
| 4" | — | — | — | — | 4.8 | 4.8 | 4.9 | 4.9 | 4.9 | 3.7 | — |
| 5° C | | | | | | | | | | | |
| 2" | F(F) | — | F | F | F | F | F | F | — | — | — |
| 2.5" | D(LOD) | —(F) | F | F | D | D | D | D | — | — | F |
| 3" | 4.2(4.3) | 3.9 | 4.2 | 4.0 | D | D | 3.5 | D | — | — | D |
| 4" | 4.8(4.7) | —(4.8) | 4.5 | 4.3 | 4.4 | D | 4.0 | 4.4 | F | F | 4.6 |
| 5" | — | — | — | — | D | 4.7 | D | 4.9 | F | F | — |
| 6" | — | — | — | — | — | — | — | — | F | F | — |

| Key: Solution: | AN | SN | $H_2O$ | Thiourea | Guar gum | Crystal habit modifier |
|---|---|---|---|---|---|---|
| a | 63.70 | 13.36 | 15.21 | 0.10 | 0.33 | sodium methylnaphthalene sulfonate-1.90 |
| b | 62.35 | 13.08 | 14.89 | 0.09 | 0.33 | sodium methylnaphthalene sulfonate-1.86 |
| c | 62.27 | 16.02 | 16.02 | 0.10 | 0.32 | sodium methylnapthalene sulfonate-0.27 |
| d | 74.27 | — | 18.09 | 0.1 | 0.34 | sodium methylnapthalene sulfonate-1.0 |
| e | 74.27 | — | 18.09 | 0.15 | 0.34 | sodium lauryl sulfate (355 active ingredient) - 5.0 |
| f | 74.27 | — | 18.09 | 0.15 | 0.34 | alkyl amyl sulfonate "Syndet 40" (40% active) - 5.0 |

[g] (70 of 73/23/4 AN/$CaCO_3$/CN: 30 $HNO_3$(60%); 0.2 thiourea; 1.0 short chain guar)
[h] sodium methylnaphthalene sulfonate
[i] 15 $H_2O$/4 sodium dichromate/3 sodium bisulfate
[j] 1 sodium nitrite/4 $H_2O$
[k] D = detonated; F = failed; LOD = low order detonation; number = detonated at velocity given in km/sec.; results in parentheses are after thirteen days's storage.

What is claimed is:

1. In an aqueous blasting composition having a continuous aqueous phase and comprising inorganic oxidizer salt, liquid hydrocarbon fuel, and thickener; the improvement which comprises (a) an immiscible liquid hydrocarbon fuel selected from the group consisting of benzene, toluene, xylene, tall oil, paraffin oil, and petroleum distillates such as gasoline, kerosene, diesel fuels and fuel oils, and mixtures of any two thereof, which fuel is finely dispersed throughout the aqueous phase, and (b) a crystal habit modifier to reduce the crystal size of the oxidizer salt and thereby stabilize the fine dispersion of the immiscible liquid hydrocarbon fuel throughout the composition.

2. A composition as defined in claim 1 wherein the crystal habit modifier is present in amounts of from about 0.05% to about 3% by weight.

3. A composition as defined by claim 2 wherein the crystal habit modifier is an anionic surfactant.

4. A composition as defined by claim 3 wherein the crystal habit modifier is sodium methylnaphthalene sulfonate.

5. A composition as defined by claim 4 wherein the immiscible liquid hydrocarbon fuel is No. 2 fuel oil.

6. A composition as defined by claim 2 comprising inorganic oxidizer salt selected from the group which consists of ammonium nitrate and sodium nitrate or mixtures thereof, from about 10 to about 30% by weight water, and from about 2 to about 8% No. 2 fuel oil.

7. A composition as defined by claim 6 wherein the oxidizer salt is ammonium nitrate.

8. Claim as defined by claim 7 wherein at least part of the ammonium nitrate is in ground form.

9. An aqueous blasting composition comprising ammonium nitrate, from about 10 to about 30% water, from about 3 to about 7% fuel oil, thickener, and from about 0.05% to about 3% sodium methylnaphthalene sulfonate as a crystal habit modifier.

10. A method of sensitizing an aqueous blasting composition having a continuous aqueous phase; oxidizer salt at least partially dissolved in the aqueous phase; thickener; and immiscible liquid hydrocarbon fuel selected from the group consisting of benzene, toluene, xylene, tall oil, paraffin oil, and petroleum distillates such as gasoline, kerosene, diesel fuels and fuel oils, and mixtures of any two thereof, which fuel is finely and stably dispersed throughout the aqueous phase; which method includes the steps of adding to the aqueous phase, at a temperature above the crystallization temperature of the oxidizer salt in the phase, a crystal habit modifier and allowing the composition to cool.

11. A method as defined by claim 10 wherein the crystal habit modifier is added in amount of from about 0.05 by weight to about 3%.

12. A method as defined by claim 11 wherein the crystal habit modifier is an anionic surfactant.

13. A method as defined by claim 12 wherein the crystal habit modifier is sodium methylnaphthalene sulfonate.

14. A method as defined by claim 10 which includes the additional step of adding to the aqueous phase ground ammonium nitrate as part of the total oxidizer salt.

15. A method of sensitizing an aqueous blasting composition having a continuous aqueous phase; oxidizer salt at least partially dissolved in the aqueous phase; thickener and immiscible liquid hydrocarbon fuel selected from the group consisting of benzene, toluene, xylene, tall oil, paraffin oil, and petroleum distillates such as gasoline, kerosene, diesel fuels and fuel oils, and mixtures of any two thereof, which fuel is finely and stably dispersed throughout the aqueous phase; which method comprises the steps of:

a. formulating a solution of oxidizer salt in water at a temperature above the salt crystallization temperature,
b. adding thickener,
c. adding a crystal habit modifier to the solution at the elevated temperature,
d. dispersing the immiscible liquid hydrocarbon fuel throughout the solution, and
e. allowing the resultant composition to cool.

16. A method as defined by claim 15 wherein the crystal habit modifier is added in amount of from about 0.05% to about 3.0% by weight.

17. A method as defined by claim 16 wherein the crystal habit modifier is an anionic surfactant.

18. A method as defined by claim 17 wherein the crystal habit modifier is sodium methylnapththalene sulfonate.

19. A method as defined by claim 15 which comprises the additional step of adding to the solution ammonium nitrate as part of the total oxidizer step.

20. A method of sensitizing an aqueous blasting composition having a continuous aqueous phase; oxidizer salt at least partially dissolved in the aqueous phase; thickener and immiscible liquid hydrocarbon fuel selected from the group consisting of benzene, toluene, xylene, tall oil, paraffin oil, and petroleum distillates such as gasoline, kerosene, diesel fuels and fuel oils, and mixtures of any two thereof, which fuel is finely and stably dispersed throughout the aqueous phase; which method comprises the steps of:

a. formulating a solution of crystal habit modifier and oxidizer salt in water added at a temperature above the salt crystallization temperature,
b. adding thickener,
c. dispersing the immiscible hydrocarbon fuel throughout the solution, and
d. allowing the resultant composition to cool.

* * * * *